United States Patent [19]

Lum

[11] Patent Number: 4,611,472

[45] Date of Patent: Sep. 16, 1986

[54] HEAT PUMP EQUIPMENT

[76] Inventor: Peter C. Lum, 80 Bonnymuir Drive, West Vancouver, British Columbia, Canada, V7S 1L2

[21] Appl. No.: 788,056

[22] Filed: Oct. 16, 1985

[51] Int. Cl.[4] ..... F25B 3/00

[52] U.S. Cl. ..... 62/499; 62/467; 62/470; 165/86

[58] Field of Search ..... 62/84, 467, 499, 470; 165/86

[56] References Cited

U.S. PATENT DOCUMENTS

| | | | |
|---|---|---|---|
| 2,811,841 | 11/1957 | Grimshaw | 62/499 |
| 3,408,828 | 11/1968 | Soumerai et al. | 62/470 |
| 3,612,168 | 10/1971 | Peterson | 165/86 |
| 3,726,107 | 4/1973 | Hintze | 62/499 |
| 4,000,777 | 1/1977 | Laing | 62/499 |
| 4,022,032 | 5/1977 | Nott | 62/499 |
| 4,144,721 | 3/1979 | Kantor | 62/499 |

*Primary Examiner*—Ronald C. Capossela

*Attorney, Agent, or Firm*—Fetherstonhaugh & Co.

[57] ABSTRACT

A heat exchange apparatus including an external rotor. An internal stator is hermetically sealed within the rotor. An inertia device, attached to the stator, is able to resist movement of the stator so that a difference in speed between the stator and the rotor can be maintained on rotation of the rotor. A refrigerant is present. A rotary compressor for the refrigerant comprises a core attached to the stator. A wheel surrounds the stator. Vanes are mounted on the wheel and are able to move with the rotor and there is a cylinder, eccentric to the vanes and attached to the stator. Oil is able to form a liquid piston on rotation. Thus relative rotation of the vanes and the cylinder compresses refrigerant as the volume between the wheel and the liquid piston decreases. There is a condenser for the compressed refrigerant. An evaporator evaporates condensed refrigerant and evaporated refrigerant is returned to the compressor. The oil can be separated and its level required for the liquid piston can be maintained.

14 Claims, 7 Drawing Figures

Fig. 2.
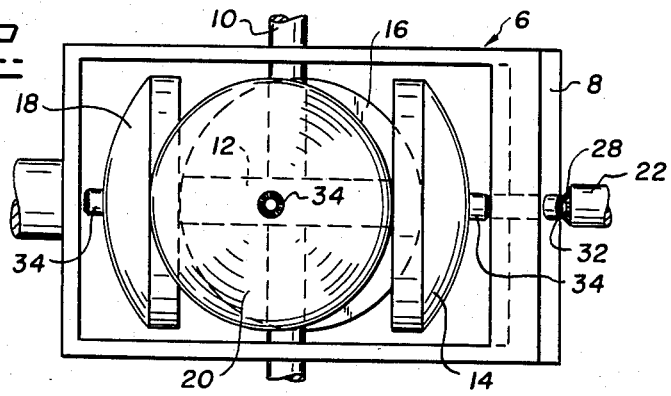
Fig. 3.
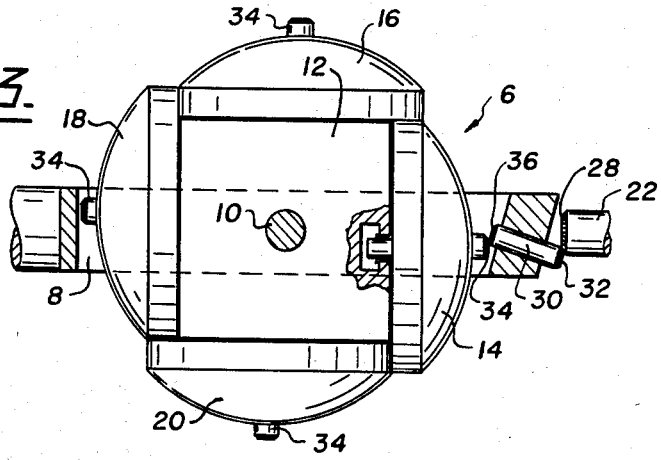
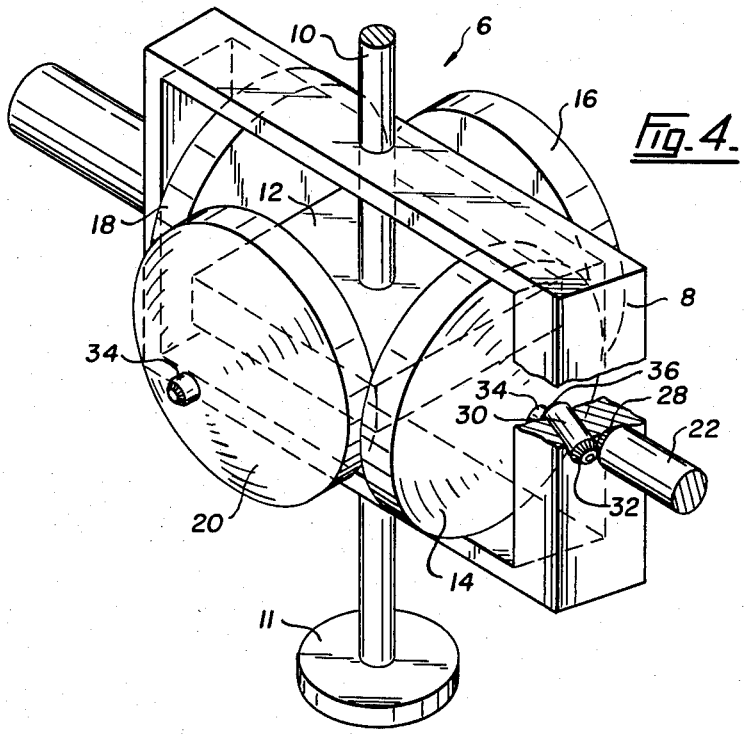
Fig. 4.

HEAT PUMP EQUIPMENT

FIELD OF THE INVENTION

This invention relates to a heat exchange apparatus.

DESCRIPTION OF THE PRIOR ART

Heat exchangers, particularly in refrigerators and heat pumps, are well known. The present invention relates to a heat exchange apparatus that is useful either as a hermetic heat pump or, in a reverse mode of operation, a heat engine.

There are known heat pumps and compressors powered by an external prime mover. If external drive they are not hermetic because the rotor must be in part internal and in part external to the casing. A hermetic compressor is known in refrigeration and heat pumps but uses an internally mounted prime mover with predictable problems. First the prime mover must be an electric motor and, furthermore, must be an induction motor providing manufacturing and servicing difficulty and low efficiency.

SUMMARY OF THE INVENTION

The present invention seeks to simplify heat exchange appartus, particularly heat pumps and heat engines, in using an apparatus that includes a high speed rotor and an inner stator, the latter hermetically sealed and possessing high angular inertia opposing the tendency of the stator to rotate. The resulting difference in speeds, between the rotor and the stator, is used to compress gas when the rotor is driven by an external force.

Accordingly the present invention provides a heat exchange apparatus comprising an external rotor; an internal stator hermetically sealed within the rotor; an inertia device attached to the stator and able to resist movement of the stator so that a difference in speed between the stator and the rotor can be maintained on rotation of the rotor; a refrigerant; a rotary compressor for the refrigerant comprising a core attached to the stator, a wheel surrounding the stator, vanes mounted on the wheel and able to move with the rotor, a cylinder, eccentric to the wheel and attached to the stator, and oil able to form a liquid piston on rotation whereby relative rotation of the vanes and the cylinder compresses refrigerant as the volume between the wheel and the liquid piston decreases; a condenser for the compressed refrigerant; an evaporator to evaporate condensed refrigerant; means to return evaporated refrigerant to the compressor; and means to separate oil and maintain oil level for liquid piston.

DRAWINGS

Aspects of the invention are illustrated, merely by way of example, in the accompanying drawings in which:

FIG. 2 is a detail of an inertia device useful in the present invention;

FIG. 3 is a further view of the inertia device;

FIG. 4 is a further view of the inertia device mounted in a frame;

DESCRIPTION OF THE PREFERRED EMBODIMENTS

Figure 1:
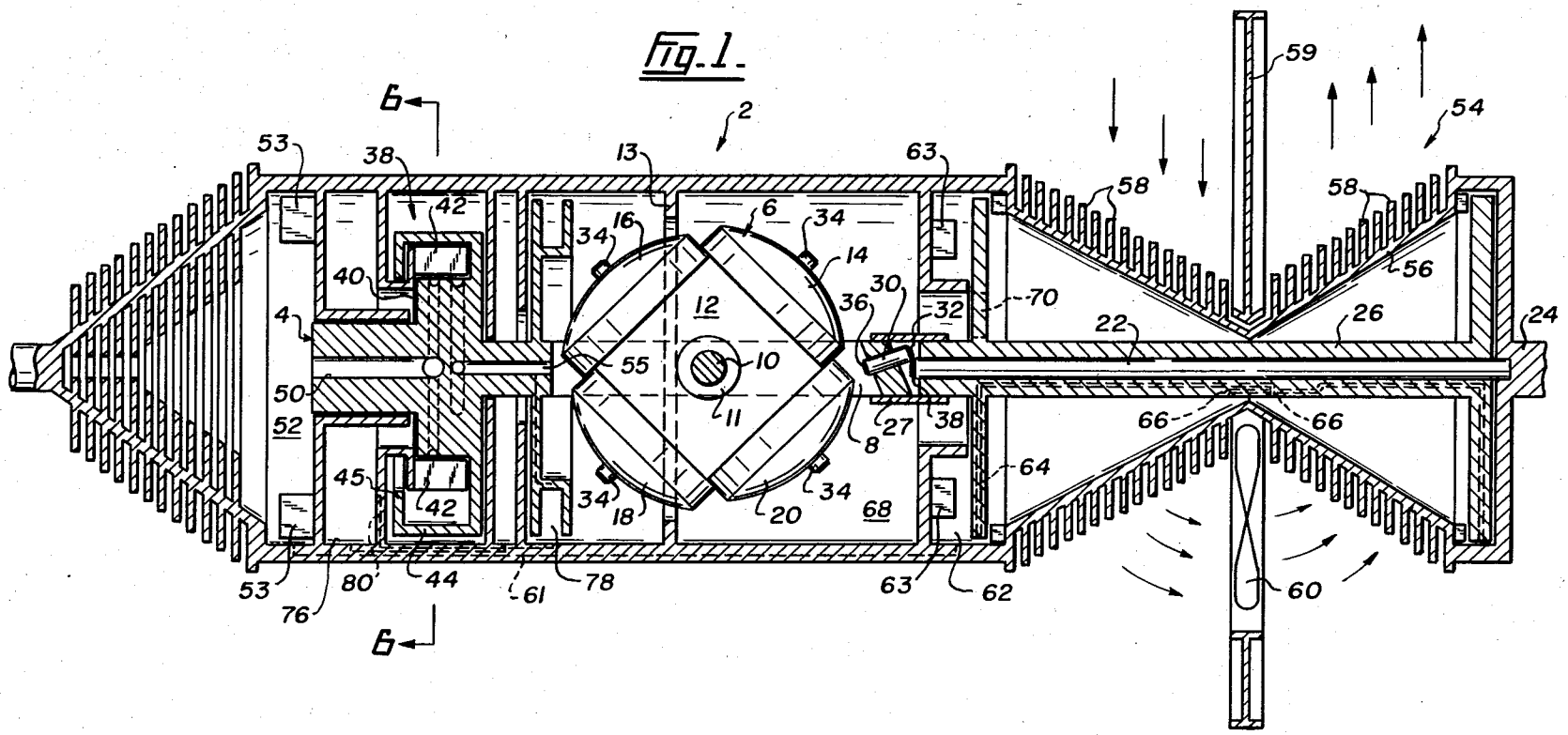
FIG. 1 is a section through a heat exchange apparatus according to the present invention.
Figure 5:
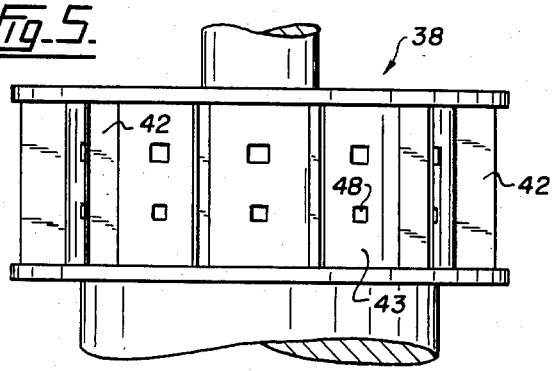
FIG. 5 is a detail of the vane mounting.

The drawings show a heat exchanger apparatus comprising an external rotor 2. There is an internal stator 4 hermetically sealed within the rotor 2. An inertia device 6 is attached to the stator 4 and is able to resist movement of the stator 4. The inertia device 6 comprises a first frame 8—see FIG. 4. There is a first shaft 10 that is attached rotatably at each end to the first frame 8. Shaft 10 is provided with a lubricant passageway (not shown). A plate 12 is rigidly mounted on the first shaft 10. Four identical fly wheels 14, 16, 18 and 20 are mounted on the plate 12 in the manner shown in FIG. 3. A drive shaft 22 forming part of rotor 2 extends from the rotor 2 at 24 through housing 26, and ends in bevel gear 28. Housing 26 forms part of the stator 4 and is linked to frame 8 by strap 27. Shaft 22 has a lubricant passageway (not shown). An inclined driven shaft 30, provided with bevel gear 32 extends through the first frame 8. The fly wheels 14 to 20 are each formed with a geared projection 34 that engages with an inner gear 36 formed on the shaft 30. It is believed clear from FIGS. 2 to 4 that each fly wheel can rotate about its own axis of rotation but that the fly wheels also rotate with the first shaft 10, the first frame 8 and the plate 12 round an axis of rotation defined by the stator 4. Furthermore the plate 12 can rotate with the first shaft 10, using the first shaft 10 as an axis of rotation.

Shaft 10 includes a wheel 11 to engage frictionally with a ring 13 formed on the interior of rotor 2. On start-up this engages projection 34 with gear 36. Subsequently the motion is self-sustaining.

The apparatus includes a refrigerant. Conventional refrigerants are appropriate.

Figure 6:
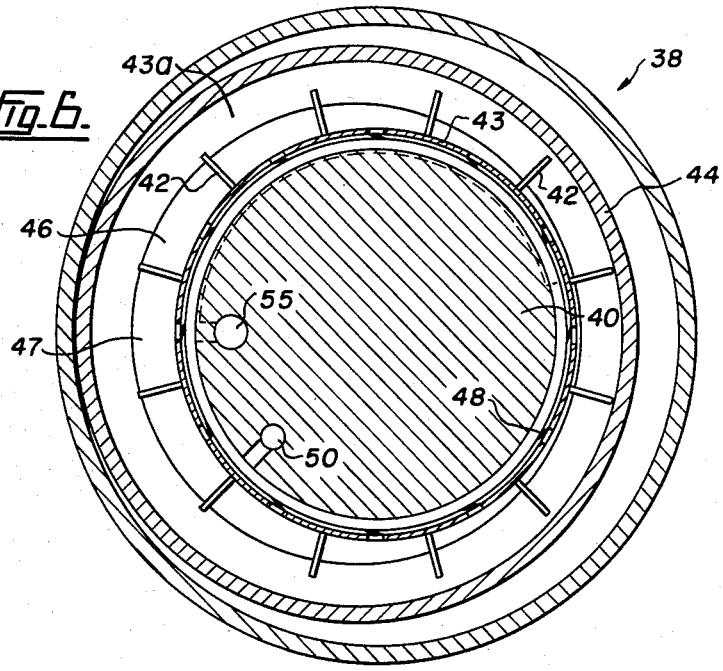
FIG. 6 is a section on the line 6—6 in FIG. 1.
Figure 7:
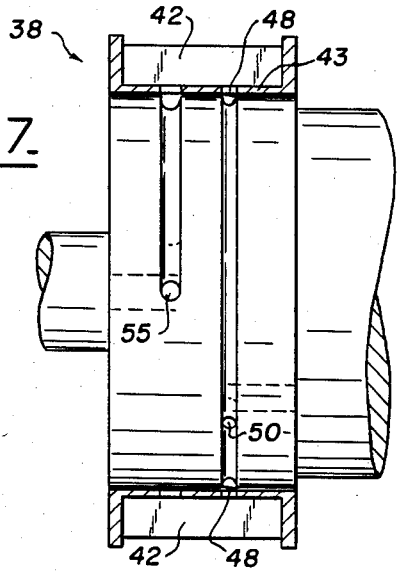
FIG. 7 is a sectional detail of FIG. 5 without the vane mounting.

There is a rotary compressor 38 for the refrigerant comprising a core 40 attached to the stator 4. There are vanes 42, mounted on wheel 43 attached to the rotor 2 and there is a cylinder 44, eccentric to the wheel 43 and attached to the stator 4 through core 40—see FIG. 1. Oil 43*a* is positioned within cylinder 44 to form a liquid piston upon rotation. The arrangement, illustrated in FIG. 6, is such that relative rotation of the vanes 42 and the cylinder 44 compresses refrigerant 47 as compartments 46 defined between the vanes 42, wheel 43 and oil 43*a* decrease in volume. Compressed refrigerant in compartments 46 passes through flap valves 48 on wheel 43 and enters the passageway 50 formed in the core 40 of the rotary compressor 38. From this passageway 50 the compressed refrigerant passes to condensor 52 where cooling, assisted by inner and outer fins, liquifies it. The refrigerant is moved from the condenser 52 by flaps 53 as discussed below.

There is an evaporator 54 comprising inclined walls 56 formed with fins 58. A fan 60 to force air over the fins 58 is provided although in this regard it must also be noted that the fins 58 are attached to the outer surface of the rotor 2 and are therefore rotating rapidly, greatly increasing heat exchange efficiency. Baffle 59 directs air in the direction shown by the arrows.

There are means to feed the refrigerant around the interior of the apparatus. Thus liquid refrigerant in condenser 52 is driven by vanes 53 through passageway 61 to compartment 62. The liquified refrigerant driven by vane 63 is then picked up by passageways 64 formed in the stator 4 and is fed to evaporator 54 through outlets 66 at the centre of the evaporator where it trickles down the inner surface of the walls 56 of the rotor 2. In doing so it evaporates, providing the necessary cooling effect, as is well known in refrigeration. Excess liquid flows back to compartment 62 where it is picked up again and is recycled across the evaporating surface 56. Equilibrium is eventually reached in the various levels of the connected reservoirs in the condenser 52, the compartment 62 and the evaporator 54. It is desirable that a small portion of the liquid be continuously trickled into the chamber 68 between the condenser 52 and the evaporator 54 so that complete evaporation distills and recovers working oil picked up by the oil liquid body.

Once the coolant is turned entirely into gas it is fed through opening 70 in the stator 4 into the interior of the apparatus and back through inlet passageway 55 to the compressor 38 where it is compressed, passed to the condenser 52 and liquified. The cycle is then repeated.

On standby the oil 43*a* in the compressor 38 falls back to an oil reservoir 76. An excess oil reservoir 78 is provided and oil passages 80 are provided to move oil as needed. On start-up the vanes 42 on wheel 43 picks up sufficient oil from reservoir 76 and oil passage 80 feeds excess oil into reservoir 78. The lip 45 on cylinder 44 establishes a level of oil 43*a* by acting as a weir or dam.

Lubrication of the apparatus is by oil pressure fed by centrifugal force into channels in stator 4, passing into all parts of the device, for example along oil passageways in shaft 10 and 22 to lubricate moving surfaces.

An important feature of the present invention is the operation of the inertia device 6. The inertia device 6 is fixed to the stator 4 and its function is to impart resistance to movement of the stator, that movement being induced by the compression load at wheel vanes acting on oil 43*a* and compartment 46. The fly wheels 14, 16, 18 and 20 mounted round the central plate 12 receive a rotational force from the rotor 2 transmitted through the gears 28, 32 and 34. Any rotational motion of the stator 4, induced by compression load, turns the shaft 10 to produce rotation of the fly wheel assembly 6 at right angles to the plane containing the mounting plate 12. This rotation causes the spinning fly wheel 14, spun by the shaft 30 driving from the rotor 2, to be placed in a position of unstable equilibrium and starts a rotation of the fly wheel assembly 6 in the plane of the mounting plate 12, in reaction to the force applied by the rotation of stator 4 about shaft 22. When the spinning fly wheel has traversed 180° it is in a position of stable equilibrium but is then pushed past that point by the subsequent fly wheel, exhibiting stronger action due to its position of maximum reaction at right angles to the two rotational axes. Thus the position is established where the reaction to the stator 4 produces opposing force of the fly wheels at 0° and 180° with the fly wheels that have passed through 180° pushing backwards, the opposing forces acting along the perimeter of the plate 12, tending to slow down the rotation along the plane of the plate 12, not being completely free to precess thus slowing down the rotation of frame 8 and thus of the stator 4.

Because the rotation of the plate 12 is restricted, rotation of the shaft 10 by frame 8 causes the fly wheels to expend energy to produce the opposing force. This in turn results in the fly wheels that have rotated through 180° possessing less force as they have expended the most energy. The other two fly wheels thus prevail and a net rotation results to sustain the cycle of energy acquired through the gears 28, 36 etc, from rotation of the rotor 2. The more the stator 4 turns the faster the plate 12 rotates and the faster the fly wheel's energy is expended, to keep the stator 4 speed low relative to the rotor 2. Thus the stator speed is always proportional with the power capacity of the reactor and the power of the system as a whole.

As the fly wheels traverse the geared drive 30, a small section of the gears protrude towards each other because of the offset mounting of the fly wheel shaft from the axis of rotation of shaft 10. The leading edge of the gear engages the inner sector in the face of the driving gear so that the leading edge velocity, even though slowed by the energy expenditure, is, on contact, at the area of contact, travelling faster than the contacting driving gear because of the smaller circumference of the inner sector when there is a corresponding lower speed. The driving gear is ratcheted to accommodate the mismatch in speed and toothpitch. As the storage fly wheel traverses further the area of contact travels towards the outer perimeter of the driving gear and the velocity becomes matched. A number of the ratchet teeth lock. The storage fly wheel then comes up to speed before being disengaged by the sustained travel past the drive gears.

Thus the present invention provides a simple yet efficient piece of equipment useful as a heat pump or engine. A single, simple primary drive is sufficient making the device simple to operate, as well as simple to manufacture.

I claim:

1. A heat exchange apparatus comprising:

an external rotor;

an internal stator hermetically sealed within the rotor;

an inertia device attached to the stator and able to resist movement of the stator so that a difference in speed between the stator and the rotor can be maintained on rotation of the rotor;

a refrigerant;

a rotary compressor for the refrigerant comprising a core attached to the stator, a wheel surrounding the stator, vanes mounted on the wheel and able to move with the rotor, a cylinder, eccentric to the vanes and attached to the stator, and oil able to form a liquid piston on rotation whereby relative rotation of the vanes and the cylinder compresses refrigerant as the volume between the wheel and the liquid piston decreases;

a condenser for the compressed refrigerant;

an evaporator to evaporate condensed refrigerant;

means to return evaporated refrigerant to the compressor; and means to separate oil and maintain oil level for the liquid piston.

2. A heat exchange apparatus as claimed in claim 1 including means to rotate the external rotor.

3. Apparatus as claimed in claim 1 in which the inertia device comprises a first frame;

a first shaft rotatably attached at each end to the first frame;

a plate mounted on the first shaft;

a plurality of fly wheels mounted on the plate, within the first frame;

drive means for the fly wheels;

drive means from the rotor engaging the drive means for the fly wheels;

whereby each fly wheel is rotated on a first axis of rotation by the rotor rotation but movement of the stator acts to rotate the first frame, on a second axis, reaction to which precesses the plate and the fly wheel on a third axis, perpendicular to the second, said precession becoming restricted by the changing relationship of the first axis to the third axis with precession about the third axis past the 180° point, so that the fly wheels, when so restricted in their precession about the third axis will oppose rotation of the stator about the second axis.

4. A heat exchange apparatus as claimed in claim 3 in which the first shaft is formed with a wheel;

a ring on the interior of the rotor;

whereby, on startup of the apparatus, the wheel engages the ring to provide friction drive of the first shaft, until the drive becomes self-sustaining.

5. A heat exchange apparatus as claimed in claim 3 in which each fly wheel has a geared projection;

a rotatable shaft mounted in the first frame, and adapted to engage the geared projection on each fly wheel;

a drive shaft attached to the rotor and adapted to engage a rotatable shaft in the first frame to rotate the rotatable shaft.

6. Apparatus as claimed in claim 1 in which the vanes form a plurality of compartments for the compressor;

an internal passageway in the compressor core to receive compressed refrigerant;

valves in each compartment to allow passage of compressed refrigerant from the compartments to the internal passageway;

an internal passageway communicating the compressor and the condenser to feed refrigerant from the compressor to the condenser.

7. A heat exchange apparatus as claimed in claim 6 in which there is an inlet passageway in the compressor core to receive refrigerant from the evaporator passing outwardly to the compartments to be compressed.

8. A heat exchange apparatus as claimed in claim 1 including passageways linking the condenser and the evaporator;

flaps in the condenser to force refrigerant in the passageways to the evaporator.

9. A heat exchange apparatus as claimed in claim 1 in which the evaporator and the condenser are formed with finned surfaces to facilitate heat exchange.

10. A heat exchange apparatus as claimed in claim 1 including a fan to force air over the exterior of the evaporator.

11. A heat exchange apparatus as claimed in claim 1 in which the evaporator has inclined surfaces to facilitate trickle flow of the refrigerant.

12. A heat exchange apparatus as claimed in claim 1 including an oil reservoir for oil used to form the piston;

a passageway to allow oil to be forced from the reservoir, as the rotor rotates, by centrifugal force.

13. A heat exchange apparatus as claimed in claim 12 including means to control the oil level in the oil reservoir.

14. A heat exchange apparatus as claimed in claim 13 in which the means to control the oil level in the oil reservoir comprises a weir in the reservoir.

* * * * *